US005608433A

United States Patent [19]

Quate

[11] Patent Number: 5,608,433

[45] Date of Patent: Mar. 4, 1997

[54] FLUID APPLICATION DEVICE AND METHOD OF OPERATION

[75] Inventor: Calvin F. Quate, Stanford, Calif.

[73] Assignee: Xerox Corporation, Stamford, Conn.

[21] Appl. No.: 294,059

[22] Filed: Aug. 25, 1994

[51] Int. Cl.[6] ..... B41J 23/14

[52] U.S. Cl. ..... 347/37; 347/40; 347/41

[58] Field of Search ..... 347/15, 43, 46, 347/37, 40, 41; 358/298

[56] References Cited

U.S. PATENT DOCUMENTS

| | | | |
|---|---|---|---|
| 4,308,547 | 12/1981 | Lovelady et al. | 347/46 |
| 4,509,058 | 4/1985 | Fischbeck | 347/40 X |
| 4,638,373 | 1/1987 | Logan | 358/298 |
| 4,697,195 | 9/1987 | Quate et al. | 347/46 |
| 4,751,530 | 6/1988 | Elrod et al. | 347/46 |
| 4,797,693 | 1/1989 | Quate | 347/46 |
| 4,801,953 | 1/1989 | Quate | 347/46 |
| 4,811,038 | 3/1989 | Gordon et al. | 347/15 X |
| 4,965,593 | 10/1990 | Hickman | 347/15 X |
| 5,028,937 | 7/1991 | Khuri-Yakub et al. | 347/46 |
| 5,041,849 | 8/1991 | Quate et al. | 347/46 |
| 5,087,931 | 2/1992 | Rawson | 347/46 |
| 5,428,381 | 6/1995 | Hadimioglu et al. | 347/46 |

*Primary Examiner*—Benjamin R. Fuller
*Assistant Examiner*—Juanita Stephens
*Attorney, Agent, or Firm*—Oliff & Berridge

[57] ABSTRACT

A fluid application device and method transfers fluid to a substrate from a fluid applicator having a plurality of ejectors. The substrate is partitioned into a matrix of cells covering the substrate and each cell includes a plurality of fluid-receiving sites. Each of the ejectors on the fluid applicator is associated with a respective one of the cells on the substrate. As fluid is ejected from the ejectors of the fluid applicator toward the substrate, the fluid applicator and substrate are moved relative to each other to cause the ejectors to scan back and forth across all of the fluid-receiving sites of each cell of the substrate. In a typical application, the fluid applicator is a printhead that ejects ink droplets toward a sheet, the printhead being approximately as large as the sheet.

34 Claims, 7 Drawing Sheets

FLUID APPLICATION DEVICE AND METHOD OF OPERATION

BACKGROUND OF THE INVENTION

1. Field of the Invention

The invention relates to fluid application devices and methods, and in particular, to devices and methods for transferring droplets of fluid, such as ink, to a substrate.

2. Description of Related Art

Various fluid application technologies, such as printing technologies, are being developed. One such technology uses focused acoustic energy to eject droplets of marking material from a printhead onto a recording medium. This application is called acoustic ink printing (AIP) and is described in a number of U.S. patents, including U.S. Pat. Nos. 4,308,547, 4,697,195, 5,028,937 and 5,087,931, the disclosures of which are incorporated herein by reference.

Acoustic ink printheads typically include a plurality of droplet ejectors, each of which launches a converging acoustic beam into a pool of liquid ink. The angular convergence of this beam is selected so that the beam comes to focus at or near the free surface of the ink, that is, at the liquid/air interface. Printing is performed by modulating the radiation pressure that the beam of each ejector exerts against the free surface of the ink, to selectively eject droplets of ink from the free surface.

More particularly, modulating the radiation pressure of each beam causes the radiation pressure to make brief, controlled excursions to a sufficiently high pressure level to overcome the restraining force of the surface tension at the free surface. Individual droplets of ink are ejected from the free surface of the pool of ink on command, with sufficient velocity to deposit them on a nearby recording medium.

Various printheads for acoustic printing also are being developed. Page-width linear and two-dimensional lens arrays for line printing are known, as are linear and two-dimensional arrays for multi-line raster printing. U.S. Pat. No. 4,751,530, the disclosure of which is incorporated herein by reference, discloses examples of such printheads.

With fluid deposition technologies such as AIP, selectively depositing marking fluid across an entire recording medium requires moving the printhead and the recording medium relative to each other until the printhead has traversed the entire recording medium. With the printheads illustrated in FIGS. 4A–4B of U.S. Pat. No. 4,751,530, for example, printing is not completed until the entire recording medium has moved past the printhead. Alternatively, with the printheads of FIGS. 4C–4D, printing is not completed until the printhead has scanned back and forth across every swath of the advancing medium. The speed with which such printing devices can print, therefore, is limited considerably.

As a further disadvantage, the physical spacing between the ejectors of many printheads limits the minimum distance between the spots printed by the printheads. In other words, because the minimum physical spacing between ejectors is limited, the minimum spacing between spots also is limited. Crosstalk between ejectors, heat transfer problems and other obstacles limit the minimum interejector spacing achievable on a printhead. Therefore, the number of spots per inch printable on the medium and thus the resolution of the printed image is limited by the number of ejectors that can be packed onto the printhead.

SUMMARY OF THE INVENTION

To overcome these and other disadvantages, a method according to an embodiment of the invention entails transferring fluid to a substrate from a fluid applicator having a plurality of fluid ejectors. The method includes associating each of the ejectors with a respective one of a matrix of cells of the substrate and ejecting fluid from each ejector toward a designated fluid-receiving site of the respective cell associated with each ejector as needed to apply a desired pattern of fluid to the substrate. The method further includes changing the designated fluid-receiving site toward which each ejector ejects fluid, and repeating the ejecting and changing steps until the fluid applicator transfers fluid to all of the fluid-receiving sites of the substrate as needed to apply the desired pattern of fluid to the substrate.

The changing step preferably includes moving the fluid applicator and the substrate relative to each other along a row of the fluid-receiving sites until fluid is transferred to all of the fluid-receiving sites of that row, as needed to apply the desired pattern of fluid to the substrate. The fluid applicator preferably moves in two dimensions relative to the substrate, and can move simultaneously with the substrate during the ejecting step. The number of ejectors of the fluid applicator is preferably equal to the number of cells of the substrate.

According to another aspect of the invention, a method according to an embodiment of the invention entails applying fluid from a fluid applicator having a plurality of ejectors to a substrate partitioned into a matrix of cells. The method includes positioning each ejector over a corresponding single cell of the substrate and moving the substrate and the fluid applicator relative to each other in two dimensions to cause each ejector to trace a pattern within its corresponding cell, so that the ejectors can apply fluid throughout their corresponding cells. The fluid applicator can move in two dimensions while the substrate is stationary, the substrate can move in two dimensions while the fluid applicator is stationary, and/or the fluid applicator and the substrate can move simultaneously.

According to another aspect of the invention, a device for applying fluid to a substrate partitioned into a matrix of cells covering the substrate includes a base element, a plurality of ejectors coupled to the base element to eject fluid toward the substrate, each ejector corresponding to a respective one of the cells of the substrate, and a scanning mechanism connected to the base element to move the base element and the substrate relative to each other, thereby scanning each ejector across all of the fluid-receiving sites of the respective cell corresponding to each ejector. The base element preferably covers all of the cells of the substrate and includes a single plate supporting the ejectors.

According to yet another aspect of the invention, the ejectors preferably are acoustic ejectors coupled to the base element to eject at least one droplet of fluid toward the substrate. Each ejector can eject multiple droplets of fluid toward a single fluid-receiving site, if desired. The scanning mechanism preferably causes the ejectors to scan across rows and columns of the fluid-receiving sites, and preferably moves the base element in two dimensions relative to the substrate.

BRIEF DESCRIPTION OF THE DRAWINGS

Preferred embodiments are described with reference to the drawings, in which like reference numerals denote like elements throughout the Figures, and in which.

DETAILED DESCRIPTION OF PREFERRED EMBODIMENTS

Methods and devices for transferring fluids to substrates according to embodiments of the invention are not limited to printing applications, such as the AIP applications disclosed in the U.S. patents incorporated by reference above. On the contrary, methods and devices according to embodiments of the invention are usable in a wide variety of applications. For example, embodiments of the invention can be applied to methods and devices for selectively coating a surface with a fluid, for applying a masking material to a surface to be etched, such as a silicon wafer, and for applying biological materials to selected substrates as a means of inducing chemical and biological reactions. Embodiments of the present invention thus are not limited to printing applications or, more specifically, to acoustic ink printing applications, although the invention is particularly well suited to such applications. Thus, while preferred embodiments of the invention periodically will be described with reference to printing applications, the invention is not limited to these embodiments.

Figure 1:
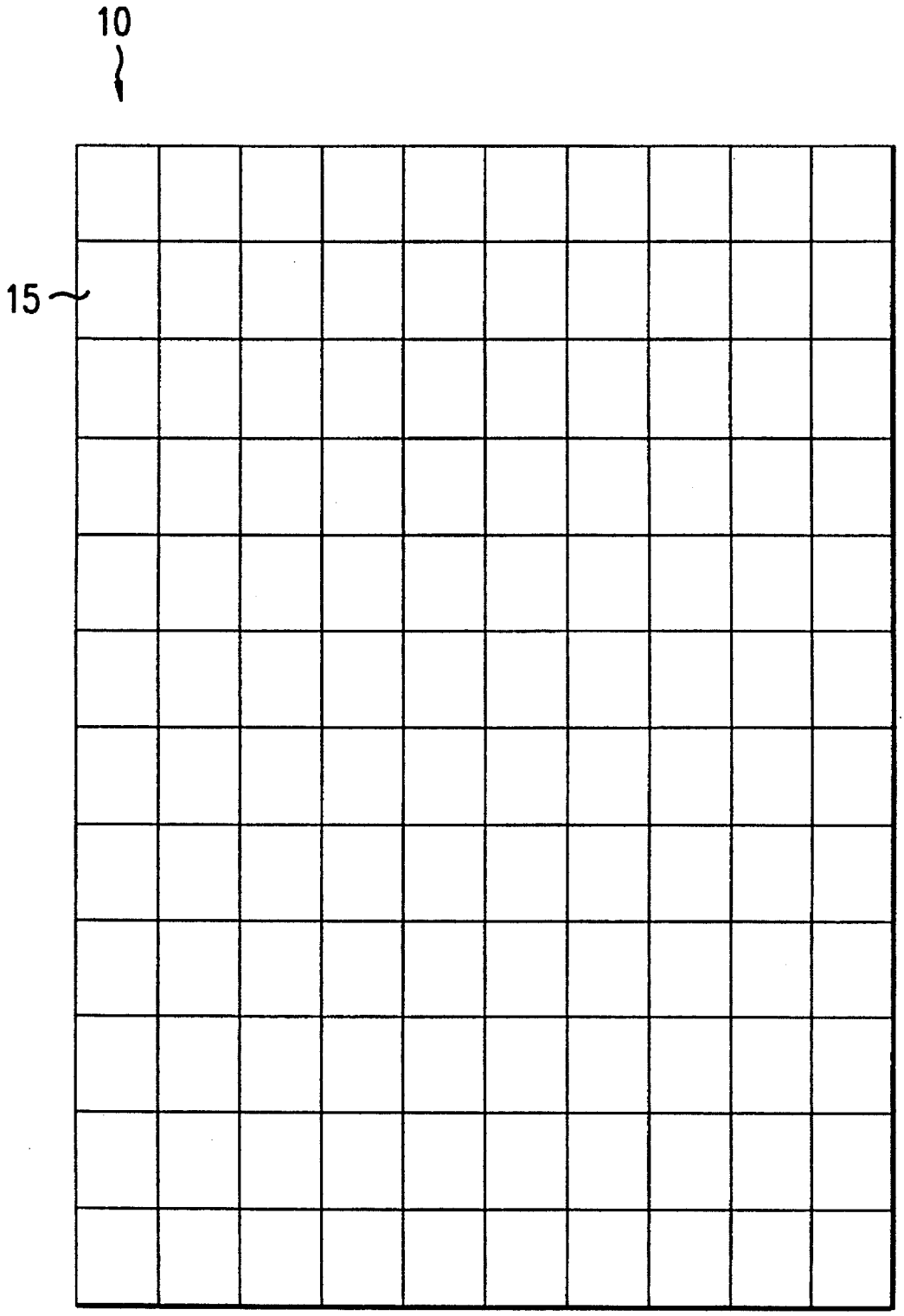
FIG. 1 is a front view of a substrate partitioned into cells according to an embodiment of the invention.

FIG. 1 illustrates a substrate 10, onto which fluid is to be deposited. In printing applications, substrate 10 is a sheet of paper or another surface onto which marking fluid, such as ink, is to be deposited. Substrate 10 is conceptually partitioned into a matrix of individual cells 15. The matrix of cells 15 forms a pattern of rows and columns of cells 15 that preferably covers the entire substrate 10, and is arranged so that a plurality of cells 15 extend across substrate 10 in first and second perpendicular directions. The matrix of cells 15 in FIG. 1 is not necessarily drawn to scale, but rather is enlarged for clarity.

In preferred embodiments, each cell 15 typically measures 1×1.5 mm or 1×3 mm. For an 8½×11 inch (216×280 mm) sheet, therefore, the matrix contains 40,320 1×1.5 mm cells or, alternatively, 20,160 1×3 mm cells. Cells according to embodiments of the invention are not limited to these measurements, however; a wide variety of cells of different shapes and sizes can be used.

Figure 2:
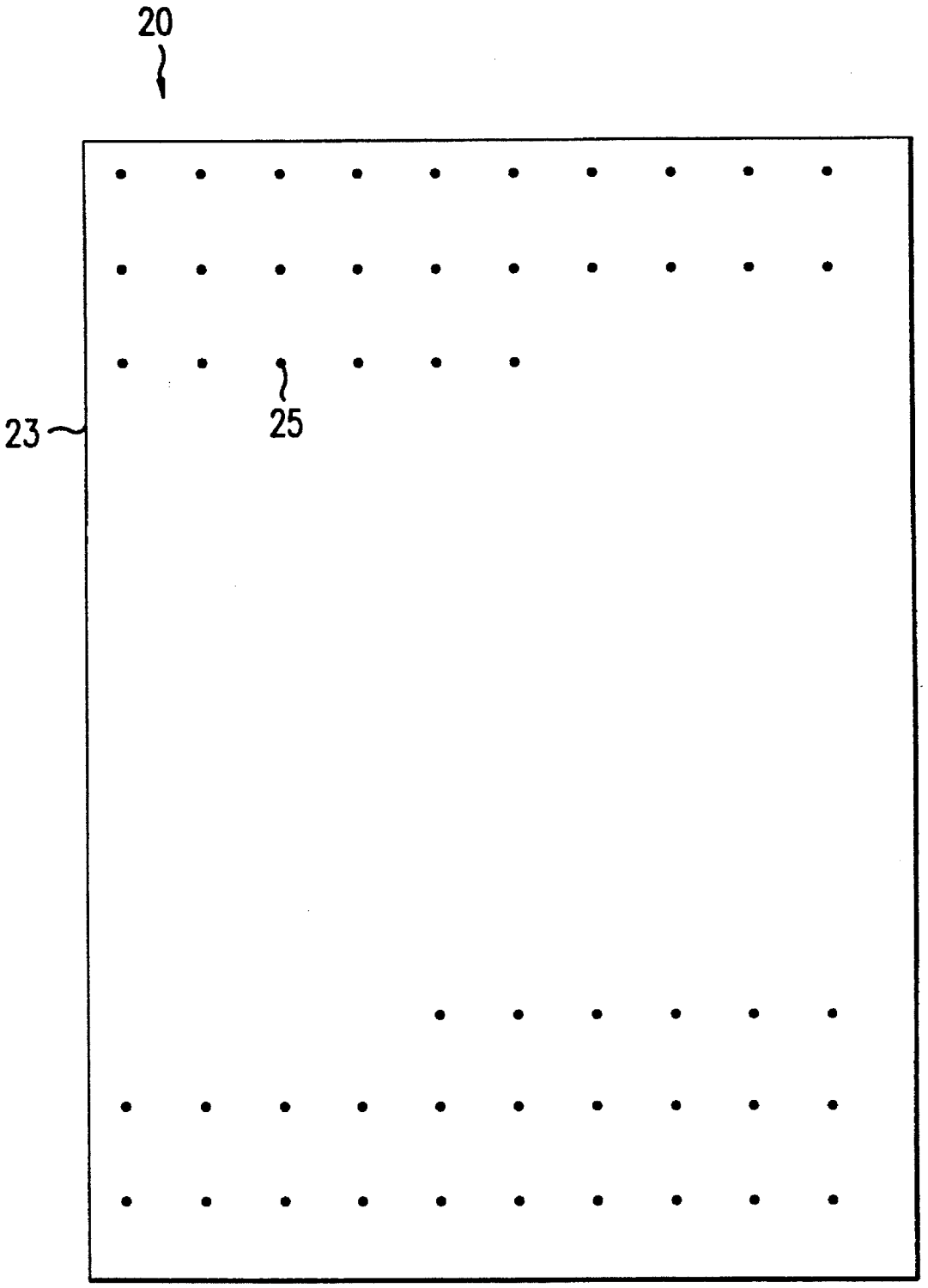
FIG. 2 is a front view of a fluid applicator according to an embodiment of the invention.

FIG. 2 illustrates fluid applicator 20 according to an embodiment of the invention. Fluid applicator 20 includes a plurality of rows and columns of fluid ejectors 25 mounted on base element 23, preferably corresponding in distribution to the rows and columns of cells 15 of substrate 10.

Fluid applicator 20 preferably includes one ejector 25 for each cell 15 of substrate 10. Consequently, fluid applicator 20 is of approximately the same dimensions as substrate 10. In a typical application, therefore, fluid applicator 20 includes approximately 20,000 to 40,000 ejectors 25. FIG. 2 illustrates considerably fewer ejectors 25, of course, for clarity.

In a printing application, fluid applicator 20 is a printhead on which ejectors 25 are mounted. More particularly, in an AIP application, printhead 20 includes acoustic ejectors 25 fabricated on a plate-like base element 23, which preferably is a single large glass plate. Of course, base element 23 can be any kind of framework suitable for supporting ejectors 25. Acoustic ejectors 25 eject droplets of marking fluid, such as ink, toward substrate 10.

Figure 7:
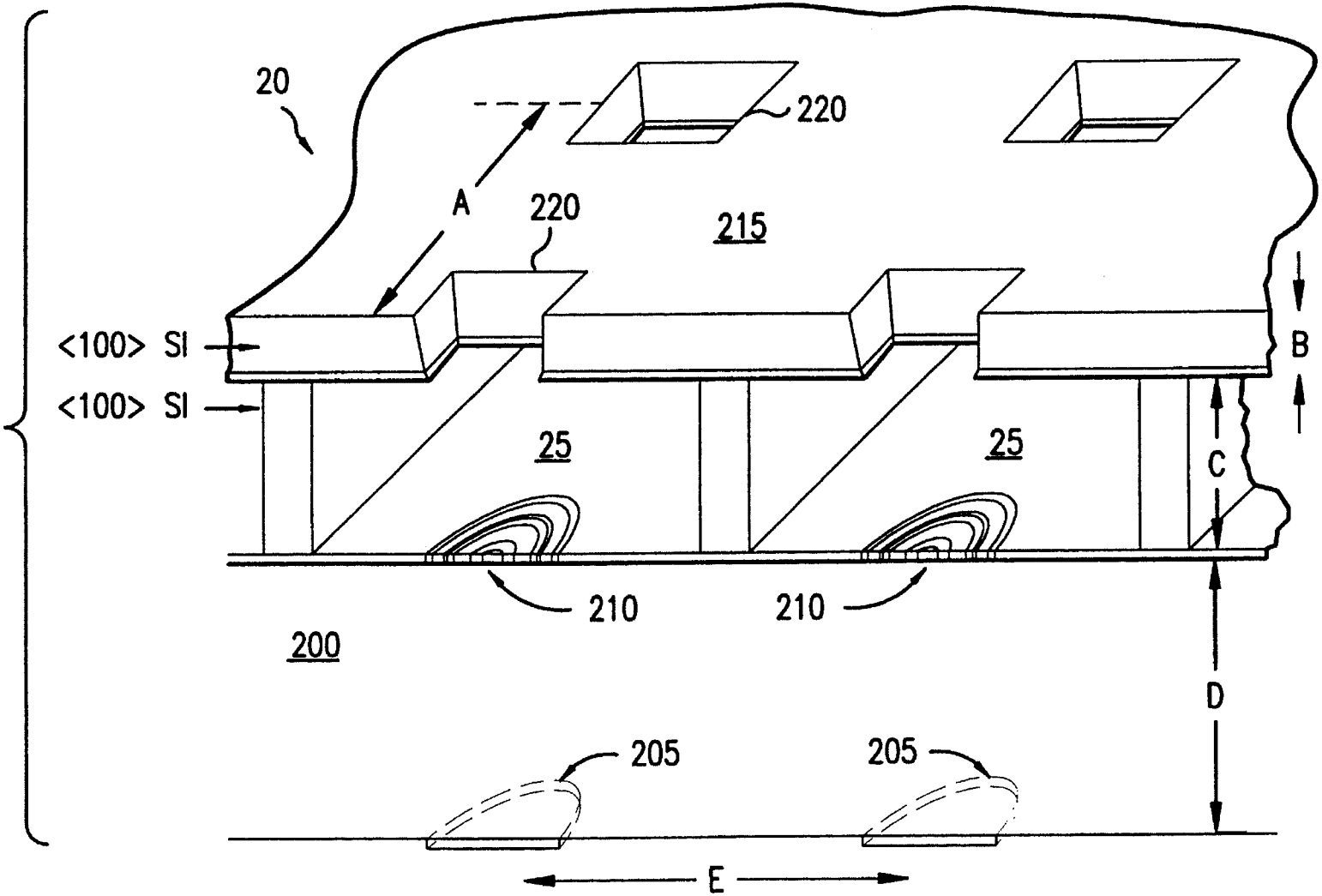
FIG. 7 is an enlarged perspective view of the FIG. 2 fluid applicator.

FIG. 7 is an enlarged view of a preferred fluid applicator 20 according to the invention. Each acoustic ejector 25 of fluid applicator 20 includes ZnO transducer 205 for acoustically illuminating Fresnel lens 210, which is supported by a preferably quartz substrate 200. Lens 210 focuses acoustic energy at a free surface of a pool of fluid (not shown), such as ink, beneath cap 215, to eject droplets of fluid through aperture 220 of cap 215. Apertures 220 are separated by a distance A, for example 340 microns. Cap 215 has a thickness B, for example 100 microns, and is spaced from the plane of lenses 210 by a distance C, for example 300 microns. The plane of lenses 210 is separated from the plane of transducers 205 by a distance D, for example 1400 microns, and transducers 205 are spaced by a distance E, for example 1000 microns.

Figure 3:
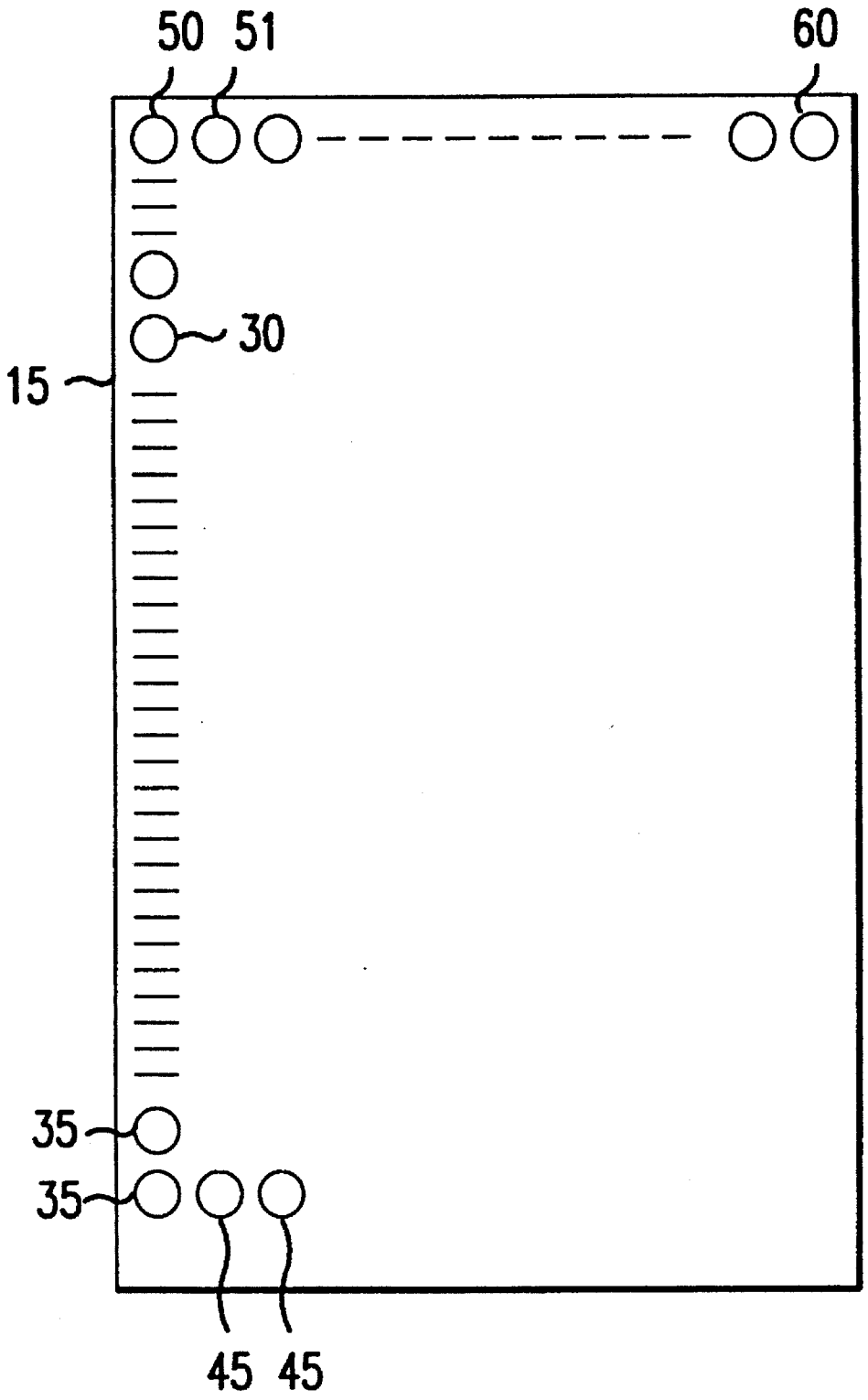
FIG. 3 is a front view showing fluid-receiving sites within a cell of the substrate, according to an embodiment of the invention.

FIG. 3 illustrates one of the cells 15 of substrate 10, according to an embodiment of the invention. Cell 15 includes a plurality of fluid-receiving sites 30, arranged in a plurality of rows (that is, lines) 35 and a plurality of columns 45. In a typical application, fluid-receiving sites 30 measure approximately 20×20 microns. For 1×1.5 mm cells, therefore, there are 40 fluid-receiving sites per line and 60 lines per cell, for a total of 2400 sites per cell. For 1×3 mm cells, there are 40 sites per line and 120 lines per cell, for a total of 4800 sites per cell. Of course, cells and/or fluid-receiving sites of other dimensions will have different numbers of sites per line, lines per cell and sites per cell.

In printing applications, fluid-receiving sites 30 are pixels and receive droplets of ink or other types of marking fluid ejected from printhead 20, as necessary to print a desired image on substrate 10. Droplets are transferred only to those pixels necessary to form a particular desired image, although printhead 20 is capable of applying droplets to every pixel 30 of every cell 15, if desired.

With conventional fluid applicators, such as the conventional printheads described above, the minimum physical spacing between ejectors determines the minimum distance between the spots of marking fluid deposited on the substrate. Consequently, the resolution of the printed image is limited by the number of ejectors that can be packed onto the printhead. According to embodiments of the invention, on the other hand, the number of spots per inch, and, consequently, the distance between respective spots, can be changed easily, merely by changing the number of droplets ejected from a particular ejector 25 toward a particular fluid-receiving site 30. The greater the number of droplets ejected, the larger the spot diameter, and the smaller the distance between spots. In other words, the area to which ink is applied on substrate 10 at a particular fluid-receiving site 30 can be enlarged by ejecting multiple droplets toward that area. Thus, the number of spots per inch can be changed easily from 900 to 600 to 300 spots per inch, for example, without changing the number of ejectors 25 on printhead 20. The degree of image resolution, therefore, is limited only by the size of the spots deposited by ejectors 25. The physical spacing between ejectors 25 on printhead 20 does not affect the degree of image resolution achievable.

Figure 4:
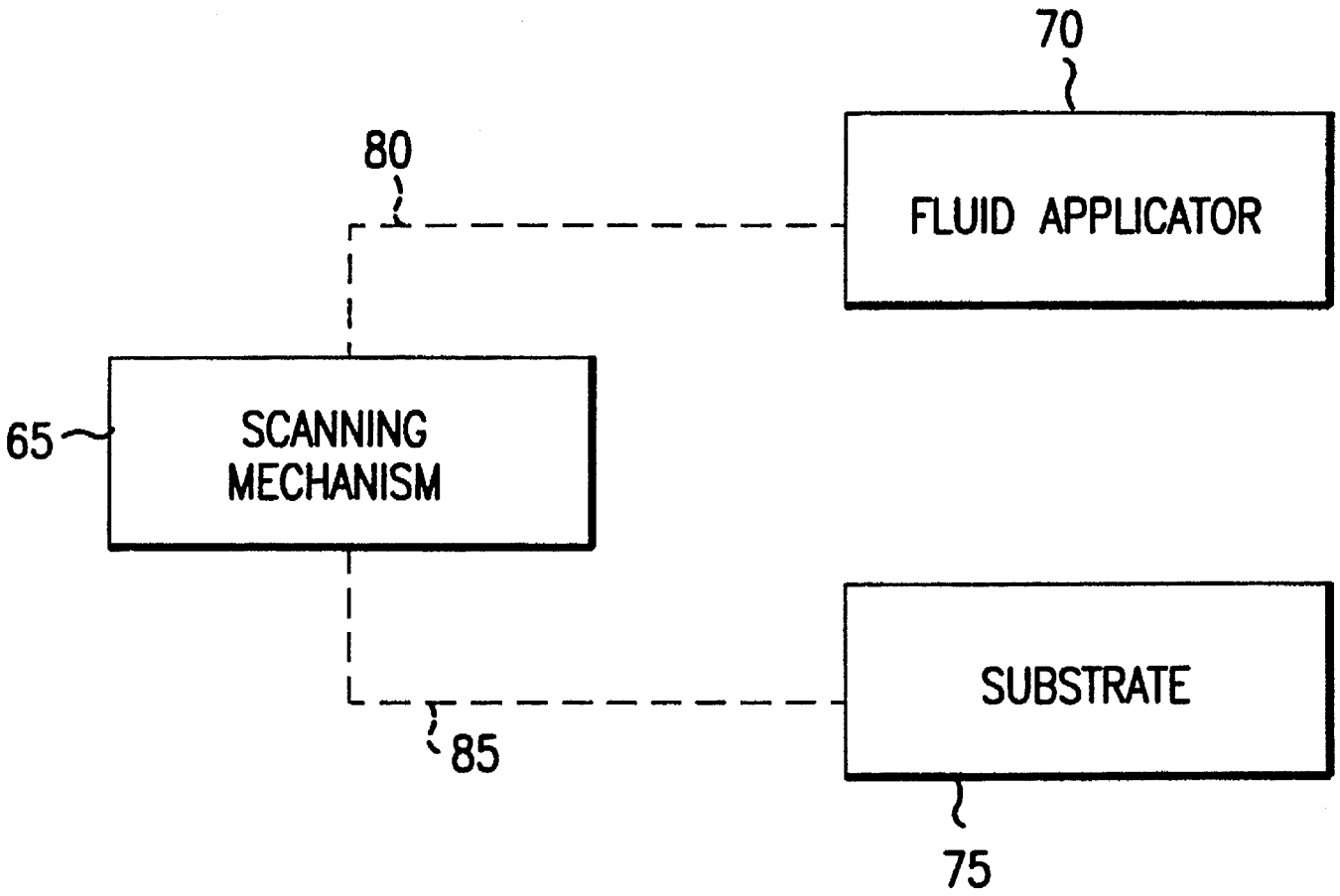
FIG. 4 is a schematic view showing a scanning mechanism, a fluid applicator and a substrate according to an embodiment of the invention.

FIG. 4 schematically illustrates a scanning mechanism 65 and its relationship to fluid applicator 20, represented in FIG. 4 as box 70, and to substrate 10, represented in FIG. 4 as box 75. Scanning mechanism 65 is operatively connected to either or both of fluid applicator 70 and substrate 75, as indicated by dashed lines 80, 85 and as now will be described.

According to embodiments of the invention, scanning mechanism 65 can be operatively connected only to fluid applicator 70, only to substrate 75, or to both fluid applicator 70 and substrate 75, as desired. Scanning mechanism 65 can include, for example, a drive, such as a motor, that is connected only to fluid applicator 70, for physically moving fluid applicator 70 with respect to substrate 75, which remains stationary. Alternatively, scanning mechanism 65 can include a drive connected only to substrate 75, for moving substrate 75 with respect to a stationary fluid applicator 70. According to a third alternative, scanning mechanism 65 can be adapted to move both fluid applicator 70 and substrate 75 simultaneously or alternately during the fluid transfer process.

Figure 6:
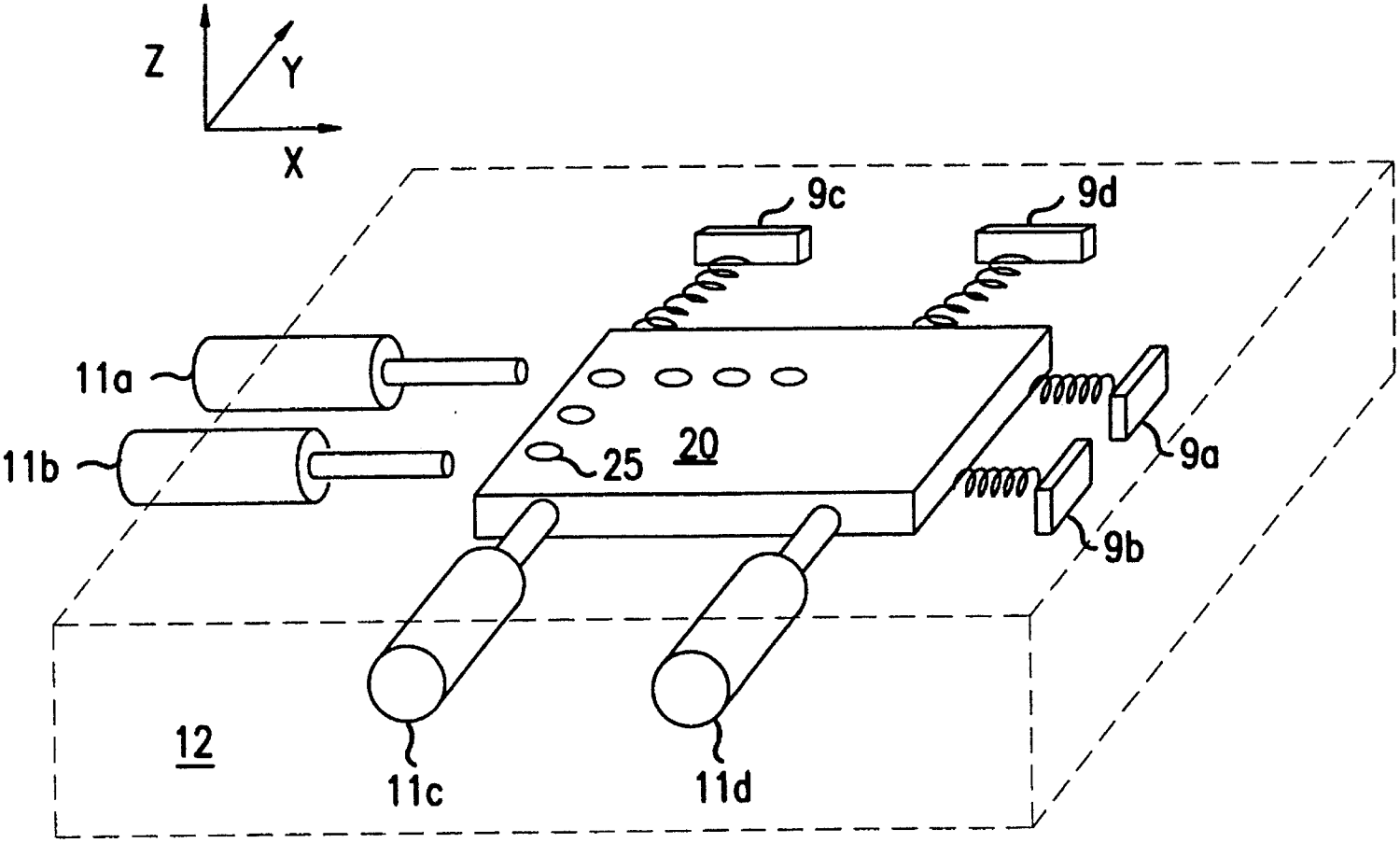
FIG. 6 is a perspective view showing a particular type of the scanning mechanism shown schematically in FIG. 4.

FIG. 6 shows a particular scanning mechanism operatively connected to the fluid applicator, according to the invention. Fluid applicator 20 with ejectors 25 is supported for movement in X and Y directions with respect to support table 12. Stepper motors 11*a*, 11*b* urge applicator 20 in the X direction against springs 9*a*, 9*b*, which resist motion in the X direction and urge applicator 20 toward motors 11*a*, 11*b*. Similarly, stepper motors 11*c*, 11*d* urge applicator 20 in the Y direction against springs 9*c*, 9*d*. A similar device can be operatively connected to the substrate, to move it with respect to a stationary fluid applicator.

Operation of the device will be described with respect to the previously described Figures and with respect to FIG. 5. In operation, fluid applicator 20 and substrate 10 are brought into proximity so that fluid can be transferred from fluid applicator 20 to substrate 10. In one application, substrate 10 is brought into underlying relationship with fluid applicator 20, but side-by-side or other relationships also are contemplated.

Fluid applicator 20 and substrate 10 first are positioned so that each ejector 25 is associated with a respective one of the cells 15 of substrate 10. More particularly, each ejector 25 preferably is physically aligned with a single respective cell 15 and is positioned to eject fluid toward at least one of the fluid-receiving sites 30 of each cell 15, that is, toward a designated fluid-receiving site 30. According to a preferred embodiment, each ejector 25 is first positioned to transfer fluid to the upper left site 50 of each cell 15.

Each ejector 25 then ejects fluid toward the cell 15 with which it is aligned, and more particularly, toward the first designated fluid-receiving site within each cell 15, as needed to apply a desired overall pattern of fluid to substrate 10. For the first such ejection, each ejector 25 preferably is aligned with the upper left fluid-receiving site 50 of each respective cell 15. Alternatively, however, each ejector 25 can be aligned with another site within each cell 15, such as the upper right site 60, or with a plurality of sites 30 within each cell 15.

As described above, each ejector 25 does not necessarily eject fluid toward every aligned fluid-receiving site 30 within its cell. The only ejectors that fire are those needed to apply a particular overall pattern of fluid to the substrate. In a typical printing application, for example, for the first possible ejection, ejectors 25 eject marking fluid only toward those upper left pixels 50 of cells 15 needed to form a desired overall image. The term "image," of course, encompasses text, lines, pictorial images, and other images that can be printed.

After the ejecting step, the designated fluid-receiving site, that is, the site toward which each ejector 25 ejects fluid, changes. According to a preferred embodiment, scanning mechanism 65 moves fluid applicator 20 and substrate 10 relative to each other, as described above with reference to FIG. 4, to change the designated site.

Figure 5:
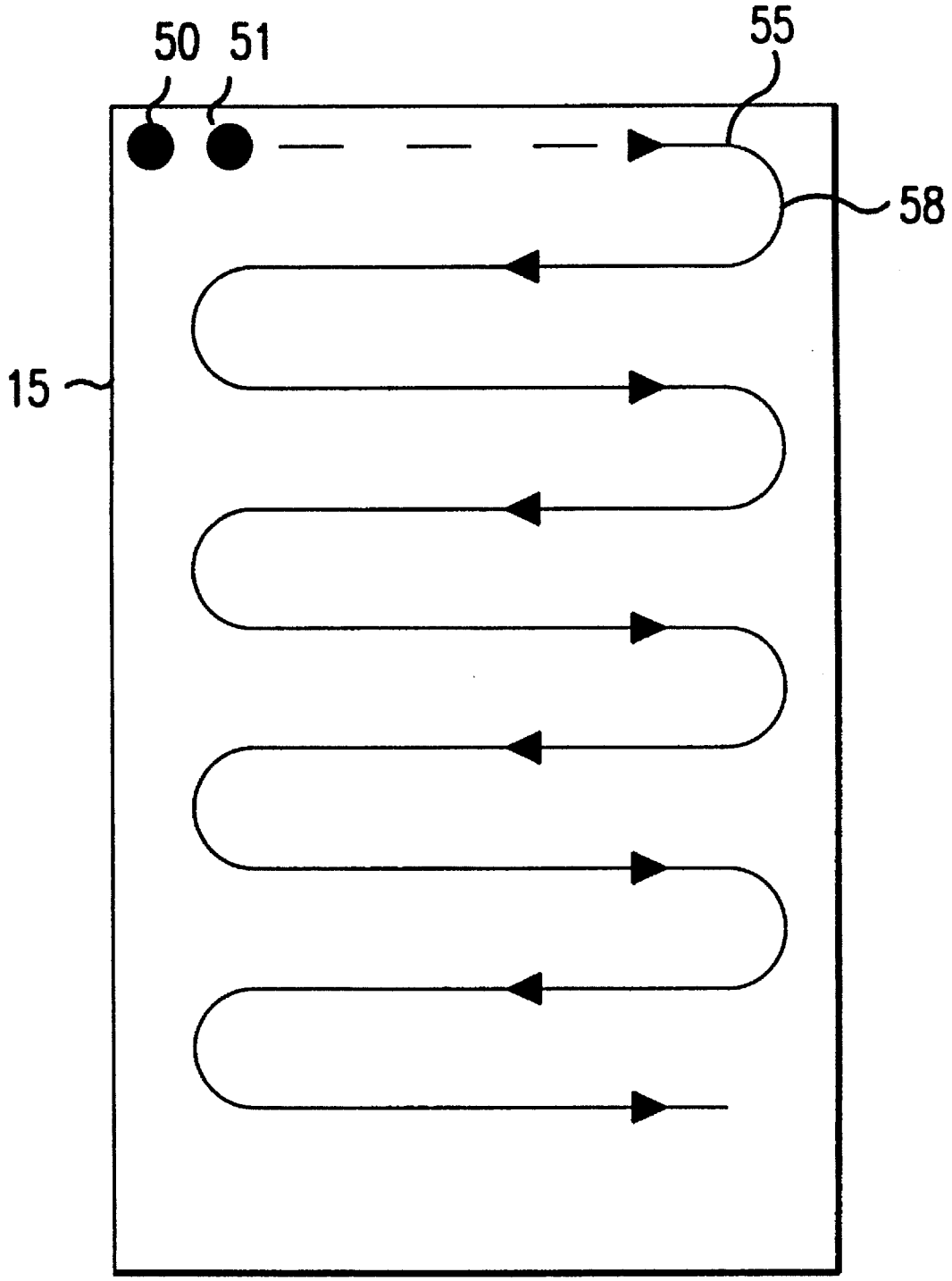
FIG. 5 is a front view showing a scan pattern of the fluid applicator with respect to a cell of the substrate, according to an embodiment of the invention.

Preferably, fluid applicator 20 and substrate 10 are moved relative to each other such that each ejector 25 traces along a scan line 55 within each cell 15, as illustrated for one cell 15 in FIG. 5. After being positioned to eject fluid toward a first designated upper left site 50, the ejector 25 for that cell moves along scan line 55 until the position of the ejector is changed so as to eject fluid from the ejector toward a different, second designated fluid-receiving site 51. In other words, each ejector 25 moves along the top row of fluid-receiving sites within each respective cell 15. The ejecting step then is repeated, so that fluid can be applied to the second designated site 51 within each cell 15, as needed to apply a desired overall pattern of fluid to the substrate.

The ejecting and changing steps are repeated until each ejector 25 has scanned across all of the fluid-receiving sites 30 in the top row of each cell 15, that is, until each ejector 25 reaches upper right cell 60. Then, fluid applicator 20 and substrate 10 are moved relative to each other so that each ejector 25 scans down the rightmost column 45 of fluid-receiving sites 30, as depicted at portion 58 of scan line 55 in FIG. 5, so that each ejector 25 becomes positioned to eject ink across the second row of each respective cell 15. Ejectors 25 continue to sweep across all of the rows of cells 15, moving along a column 45 at the end of each row, until ejectors 25 have swept all of the sites on substrate 10 and fluid applicator 20 has applied the desired overall pattern of fluid to substrate 10. Fluid applicator 20 and substrate 10 thus move relative to each other in two dimensions, along the rows and columns of cells 15.

In FIG. 5, portion 58 of scan line 55 is curved, as is normally the case when scanning mechanism 65 is moving both substrate 10 and fluid applicator 20 simultaneously. Alternatively, portion 58 of scan line 55 can be straight instead of curved, as is normally the case when either substrate 10 or fluid applicator 20 is stationary as scanning mechanism 65 moves substrate 10 and fluid applicator 20 relative to each other.

Of course, scanning patterns other than that represented by scan line 55 in FIG. 5 are possible. For example, ejectors 25 can scan from the upper right sites 60 in the top rows of cells 15 toward the upper left sites 50 and then down the leftmost columns of cells 15. Alternatively, ejectors 25 can scan up and down columns 45 of cells 15 instead of back and forth across rows 35. Numerous other scanning patterns also are possible.

According to a preferred embodiment, ejectors 25 perform a fast-scan operation along rows 35 and a slow-scan operation along columns 45. Fluid applicator 20 and substrate 10 move relative to each other faster along rows 35 than along columns 45. In a typical printing application, the scan speed of ejectors 25 across rows 35 of sites 30, that is, the horizontal speed, is about 12 cm per second for 1×1.5 mm cells and about 24 cm per second for 1×3 mm cells. The vertical speed, along columns 45 of sites 30, is about 3 mm per second for 1×1.5 mm cells and about 6 mm per second for 1×3 mm cells.

The horizontal and vertical scan speeds according to embodiments of the invention are modest compared to those of typical printing devices, which can have horizontal speeds, for example, of up to 50 cm per second. The relatively large size of printhead 20 and the relatively large number of ejectors 25 on printhead 20 allow scan speeds slower than in typical prior art printing devices. Slower scan speeds yield a number of advantages, such as reduced power requirements for moving printhead 20 and substrate 10 relative to each other.

Despite the relatively modest scan speeds, extremely high printing speeds can be achieved according to embodiments of the invention, due to the large size of the printhead and the large number of ejectors on the printhead. Printing speeds of up to 120 sheets per minute, that is, 0.5 second per page, are achievable. At 0.5 second per page, each ejector 25 traverses its entire respective cell 15 in 0.5 second, yielding a printing speed of 4800 pixels per cell per second for 1×1.5 mm cells and 9600 pixels per cell per second for 1×3 mm cells. A printing device according to embodiments of the invention, therefore, achieves very high page throughput with relatively low scanning speeds.

According to another aspect of the invention, different types of fluid are applied within each cell. In a printing application, the different types of fluid can be marking fluids of different colors, making color printing possible at very high speeds. For color printing, a plurality of ejectors 25, one for each color ink, are aligned with each cell 15. Ample room exists for including more than one nozzle per cell on printhead 20. As printhead 20 traverses the rows of pixels in each cell 15, ejectors 25 fire as needed to print a desired color image on substrate 10. Of course, ejectors 25 can apply other types of fluids, not just different colored marking fluids, in printing and other applications according to embodiments of the invention.

While the invention has been described with reference to specific embodiments, the description is illustrative and is not to be construed as limiting the scope of the invention. For example, as described above, printing applications, coating applications, masking applications, and various other applications can be achieved. Various other modifications and changes may occur to those skilled in the art without departing from the spirit and scope of the invention.

What is claimed is:

1. A method of transferring fluid to a substrate from a fluid applicator having a plurality of fluid ejectors, the substrate being partitioned into a matrix of cells covering the substrate, the substrate having a predetermined width, and the cells each including a plurality of fluid-receiving sites, the fluid applicator having a width substantially equal to the predetermined width, the method comprising the steps of:

associating each ejector of the fluid applicator with a respective one of the cells of the substrate;

ejecting fluid from each ejector toward a designated fluid-receiving site of the respective cell associated with each ejector as needed to apply a desired pattern of fluid to the substrate;

changing the designated fluid-receiving site within the respective cell associated with each ejector toward which each ejector ejects fluid; and repeating the ejecting and changing steps until the fluid applicator transfers fluid to all of the fluid-receiving sites of the substrate as needed to apply the desired pattern of fluid to the substrate.

2. The method of claim 1, wherein the associating step includes the step of physically aligning each ejector of the fluid applicator with a respective one of the cells.

3. The method of claim 1, wherein the changing step includes the step of moving the fluid applicator and the substrate relative to each other to change the designated fluid-receiving site toward which each ejector ejects fluid.

4. The method of claim 3, wherein the moving step includes moving the substrate and the fluid applicator simultaneously.

5. The method of claim 3, wherein the moving step occurs during the ejecting step.

6. The method of claim 3, wherein the repeating step includes moving one of the fluid applicator and the substrate in two dimensions relative to the other of the fluid applicator and the substrate.

7. The method of claim 1, wherein the fluid-receiving sites of each cell are arranged in a plurality of rows and a plurality of columns.

8. The method of claim 7, wherein the changing step includes moving the fluid applicator and the substrate relative to each other along at least one row of fluid-receiving sites of each cell until the fluid applicator traverses all of the fluid-receiving sites of said one row.

9. The method of claim 8, wherein the changing step further includes moving the fluid applicator and the substrate relative to each other along at least one column of fluid-receiving sites at the end of said at least one row.

10. The method of claim 8, wherein the moving step includes tracing a raster pattern across successive rows of fluid-receiving sites of each cell.

11. The method of claim 1, wherein the substrate is partitioned into a plurality of cells extending across the substrate in a first direction and a plurality of cells extending across the substrate in a second direction perpendicular to the first direction.

12. The method of claim 1, wherein the ejecting step includes ejecting at least one droplet of fluid from each ejector.

13. The method of claim 1, wherein the ejecting step includes ejecting multiple droplets of fluid from each ejector toward the designated fluid-receiving site, to enlarge the amount substrate area covered by the fluid at the designated fluid-receiving site.

14. The method of claim 1, wherein the fluid applicator comprises a printhead, the fluid comprises marking fluid, and the fluid-receiving sites comprise pixels, so that the ejecting step includes ejecting marking fluid from each ejector of the printhead toward a designated pixel of the respective cell associated with each ejector as needed to print a desired image on the substrate.

15. The method of claim 1, wherein the number of ejectors of the fluid applicator is equal to the number of cells of the substrate so that the associating step includes associating each of the ejectors of the fluid applicator with a single respective one of the cells.

16. The method of claim 1, wherein the fluid comprises different types of fluid and the associating step includes associating a plurality of ejectors, one ejector for each of the types of fluid, with a single respective one of the cells.

17. The method of claim 16, wherein the different types of fluid comprise different colored marking fluids and the fluid applicator comprises a printhead, so that the ejecting step includes ejecting different colored marking fluids from the printhead as needed to print a desired image on the substrate.

18. A method of applying fluid from a fluid applicator having a plurality of ejectors to a substrate partitioned into a matrix of cells, the substrate having a predetermined width, and the fluid applicator having a width substantially equal to the predetermined width, the method comprising the steps of:

moving the substrate and the fluid applicator relative to each other in two dimensions to cause each ejector to trace a pattern with the cell corresponding to each ejector so that the ejectors can apply fluid throughout the corresponding cells.

19. The method of claim 18, wherein the moving step includes moving the fluid applicator in two dimensions while the substrate is stationary.

20. The method of claim 18, wherein the moving step includes moving the substrate in two dimensions while the fluid applicator is stationary.

21. The method of claim 18, wherein the moving step includes simultaneously moving the substrate and the fluid applicator.

22. The method of claim 18, wherein the pattern comprises a raster pattern extending back and forth across successive portions of each cell.

23. A device for applying fluid to a substrate having a predetermined width substantially equal to a predetermined width of the device, the substrate being partitioned into a matrix of cells covering the substrate and the cells each comprising a plurality of fluid-receiving sites, the device comprising:

a base element;

a plurality of ejectors coupled to the base element to eject fluid toward the substrate, each ejector corresponding to a respective one of the cells of the substrate; and a scanning mechanism connected to at least one of the base element and the substrate to move the base element and the substrate relative to each other, thereby scanning each ejector across all of the fluid-receiving sites of the respective cell corresponding to each ejector.

24. The device of claim 23, wherein the base element covers all of the cells of the substrate.

25. The device of claim 23, wherein the base element comprises a single plate supporting the ejectors.

26. The device of claim 23, wherein the ejectors comprise acoustic ejectors each coupled to the base element to eject at least one droplet of fluid toward the substrate.

27. The device of claim 23, wherein each ejector is arranged to eject multiple droplets of fluid toward a single respective fluid-receiving site.

28. The device of claim 23, wherein the base element and the ejectors form a printhead for applying marking fluid to the substrate.

29. The device of claim 23, wherein:

the fluid-receiving sites are arranged in a plurality of rows and columns within each cell; and the scanning mechanism causes the ejectors to scan across the rows and columns of fluid-receiving sites within the respective cells corresponding to the ejectors.

30. The device of claim 23, wherein the scanning mechanism moves the base element while the substrate is stationary.

31. The device of claim 23, wherein the scanning mechanism moves the substrate while the base element is stationary.

32. The device of claim 23, wherein the scanning mechanism moves the base element and the substrate simultaneously while the ejectors eject fluid toward the substrate.

33. The device of claim 23, wherein the scanning mechanism moves at least one of the base element and the substrate in two dimensions relative to the other of the base element and the substrate.

34. The device of claim 23, wherein the number of ejectors is equal to the number of cells of the substrate.

* * * * *